US005638968A

United States Patent [19]

Baron et al.

[11] Patent Number: 5,638,968

[45] Date of Patent: Jun. 17, 1997

[54] BABY BOTTLE EXTENSION ASSEMBLY HAVING STORAGE CHAMBER AND RELEASE MECHANISM

[76] Inventors: Moises S. Baron; Sharon Lerner-Baron, both of 637 Third Ave., Ste. F, Chula Vista, Calif. 91910

[21] Appl. No.: 607,240

[22] Filed: Feb. 26, 1996

[51] Int. Cl.[6] ..... A61J 9/00

[52] U.S. Cl. ..... 215/11.4; 215/6; 215/DIG. 8; 206/221

[58] Field of Search ..... 215/11.1, 11.4, 215/11.6, 387–389, DIG. 8, 6; 206/221; 604/416; 220/8, 502, 521, 256, 705, 4.03; 222/129

[56] References Cited

U.S. PATENT DOCUMENTS

| | | | |
|---|---|---|---|
| Re. 29,916 | 2/1979 | Schmid et al. | 426/117 |
| 730,337 | 6/1903 | Bonnefont | 215/11.1 |
| 2,786,769 | 3/1957 | Greenspan | 99/171 |
| 2,793,776 | 5/1957 | Lipari | 215/6 |
| 2,807,384 | 9/1957 | Lipari . | |
| 2,813,649 | 11/1957 | Lipari . | |
| 2,843,281 | 9/1958 | Gallois . | |
| 2,885,104 | 5/1959 | Greenspan | 215/6 |
| 2,931,931 | 4/1960 | Pohjola | 99/171 |
| 3,093,256 | 6/1963 | Woodbury, Jr. . | |
| 3,323,669 | 6/1967 | Yazaki . | |
| 3,924,741 | 12/1975 | Kachur et al. | 206/221 |
| 4,135,513 | 1/1979 | Arisland | 215/11.5 |
| 4,253,588 | 3/1981 | Lester et al. | 222/153 |
| 4,513,861 | 4/1985 | Baram | 215/DIG. 8 |
| 4,856,995 | 8/1989 | Wagner | 433/215 |
| 4,979,629 | 12/1990 | Askerneese | 215/11.1 |
| 5,060,811 | 10/1991 | Fox | 215/6 |
| 5,078,287 | 1/1992 | Holmes, III | 215/11.6 X |
| 5,088,627 | 2/1992 | Musel | 215/DIG. 8 |
| 5,217,433 | 6/1993 | Bunin | 215/DIG. 8 |
| 5,275,298 | 1/1994 | Holley, Jr. et al. | 215/11.4 |
| 5,295,597 | 3/1994 | Green | 215/11.4 |
| 5,433,328 | 7/1995 | Baron et al. | 215/DIG. 8 |

FOREIGN PATENT DOCUMENTS

| | | | |
|---|---|---|---|
| 410922 | 1/1991 | European Pat. Off. | 222/524 |
| 679145 | 12/1991 | Switzerland | 215/11.1 |

*Primary Examiner*—Allan N. Shoap
*Assistant Examiner*—Christopher J. McDonald
*Attorney, Agent, or Firm*—John R. Flanagan

[57] ABSTRACT

An extension assembly fits between a tubular container of a baby bottle and a nipple end cap. The assembly includes a container body attached to the nipple end cap and having an internal chamber and a lower attaching structure connected to an upper open end of the tubular container and a release mechanism to control access by water in the tubular container to food material in the container body. The mechanism has a lower annular funnel sloping from an annular outer edge to an annular inner edge which defines a central opening aligned with the upper end of the tubular container. A central stopper structure supported by a lower open end of the container body is movable toward and away from the annular funnel structure as the container body moves within a sleeve extending upwards from the annular funnel structure. This movement prevents and permits access by water in the tubular container to the food material in the container body.

20 Claims, 2 Drawing Sheets

BABY BOTTLE EXTENSION ASSEMBLY HAVING STORAGE CHAMBER AND RELEASE MECHANISM

CROSS-REFERENCE TO RELATED INVENTION

The present invention is related to the subject matter disclosed in U.S. Pat. No. 5,433,326 which issued on Jul. 18, 1995 to the inventors herein.

BACKGROUND OF THE INVENTION

1. Field of the Invention

The present invention generally relates to baby nursing or feeding bottles and, more particularly, is concerned with a baby bottle extension assembly having a storage chamber and release mechanism.

2. Description of the Prior Art

Bottle fed babies are typically fed a milk-like mixture of water and a liquid baby food material generally referred to as "baby formula" which can be purchased in any grocery store or supermarket. For various reasons, one of which is food freshness and nutritional wholesomeness, it is desirable to be able to mix the baby formula with the required quantity of water just before feeding the mixture to the baby.

Thus, when a baby is taken on a trip away from home, an adult caring for the baby must transport one or more bottles filled with water and also transport one or more containers of baby formula separately therefrom for mixing therewith when it is time to feed the baby. Thus, it would be desirable to provide a device having a design which facilitate the process of preparing, transporting and utilizing baby bottles at all times of the day and night and in all places. Such design would allow for the water and baby formula to remain separate within the bottle, until the moment that they need to be mixed to feed to the baby, and would employ currently used standard baby bottle constructions.

Designs have been proposed in the prior patent art to provide baby bottles with separate compartments for containing food ingredients to be mixed and fed together or even to be fed separately from the bottle. Representative examples of such designs are the ones discloses in Swiss patent to Fluck (679,145) and in U.S. patents to Greenspan (U.S. Pat. Nos. 2,786,769; 2,885,104), Lipari (U.S. Pat. Nos. 2,793,776; 2,807,384; 2,813,647), Gallois (U.S. Pat. No. 2,843,281), Pohjola (U.S. Pat. No. 2,931,731), Wagner (U.S. Pat. No. 4,856,995), Askerneese (U.S. Pat. No. 4,979,629) and Fox (U.S. Pat. No. 5,060,811).

The above-cited U.S. patents to Lipari disclose various embodiments of a compartmental nursing bottle. U.S. Pat. No. 2,793,776 discloses a nursing bottle having an outer container filled with water and an inner tubular body filled with a formula being supported within the outer container and having a plunger slidable therein for opening communication between the inner tubular body and the interior chamber of the outer container. U.S. Pat. No. 2,807,384 discloses a nursing bottle having upper and lower compartments filled with formula and water respectively and separated by a rupturable diaphragm disposed across a restricted passage connecting the compartments. A valve and stopper assembly is provided in the upper compartment and operable for effecting rupture of the diaphragm. U.S. Pat. No. 2,813,649 discloses a nursing bottle similar to that of the previous patent, except that the latter uses a movable stopper to close and open the restricted passage.

The Lipari compartmental nursing bottle designs appear to be overly complicated and furthermore are not adapted for use with the generally accepted standard baby bottle constructions. As a result, the Lipari designs do not appear to be a satisfactory approach to the objective of providing a baby bottle design having features which would faciliate the separate storage of water and baby formula and then the easy mixing thereof at the moment that they need to be mixed in order to feed the baby, which design utilizes to the extent feasible currently accepted baby bottle constructions.

Consequently, a need still exists for a design which meets the desired performance objectives and is compatiable with current baby bottle constructions.

SUMMARY OF THE INVENTION

The present invention provides a baby bottle extension designed to satisfy the aforementioned need. The extension assembly of the present invention is adapted to fit between a tubular container and a nipple supporting end cap for the tubular container of a baby bottle. Thus, the extension assembly is designed to complement currently used standard baby bottles.

Accordingly, the present invention is directed to a baby bottle extension assembly adapted to fit with and between a tubular container of a baby bottle and a nipple end cap of the baby bottle. The extension assembly comprises: (a) an elongated container body for storing a quantity of food material, the container body having spaced upper and lower open ends, an internal storage chamber defined between the upper and lower ends, and an upper attaching structure defined about the upper open end and adapted to connect with the nipple end cap; (b) a lower annular attaching structure adapted to connect with an upper open end of the tubular container; (c) a release mechanism to control access by water in the tubular container to the food material in the container body, the release mechanism including a lower annular funnel structure overlying and connected to the lower annular attaching structure, the annular funnel structure having an outer annular edge portion, an inner annular edge portion, and an annular wall disposed above and overlying the lower annular attaching structure and sloping from the outer annular edge portion inwardly and downwardly to the inner annular edge portion and a central opening defined by the inner annular edge portion, the central opening spaced inwardly from the lower annular attaching structure and aligned with the upper open end of the tubular container, the release mechanism also including a central stopper structure supported by and spaced from a lower end of the container body and movable toward and away from the lower annular funnel structure between closed and opened conditions relative to the central opening of the lower annular funnel structure with movement of the container body toward and away from the upper end of the tubular container to thereby respectively prevent and permit access by water in the tubular container to the food material in the container body; and (d) means in the form of a sleeve attached to and extending upwardly from the outer annular edge portion of the annular funnel structure for mounting the container body to undergo movement toward and away from the tubular container so as to convert the release mechanism between the closed condition blocking access by the water in the tubular container with the food material in the container body and the opened condition permitting access by the water in the tubular container to the food material stored in the container body to facilitate shaking and mixing of the water with the food material.

More particularly, the upper stopper structure includes a central cover having an upwardly convex-shaped top with an annular rim depending from the periphery of the cover and sealably seated within the central opening of the lower annular funnel structure when the upper stopper structure and lower funnel structure are in the closed condition and being unseated therefrom when the upper stopper structure and lower funnel structure are in the opened condition. Further, the upper stopper structure also includes a plurality of radial spokes extending between and attached to a peripheral edge of the top of the central cover and the lower annular open end of the container body, the radial spokes being spaced apart so as to define spaces therebetween which permit the shaking and mixing of water with food material through the spaces pass the radial spokes and central cover and through the central opening of the lower funnel structure when the upper stopper structure is at an opened condition relative to the lower funnel structure.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
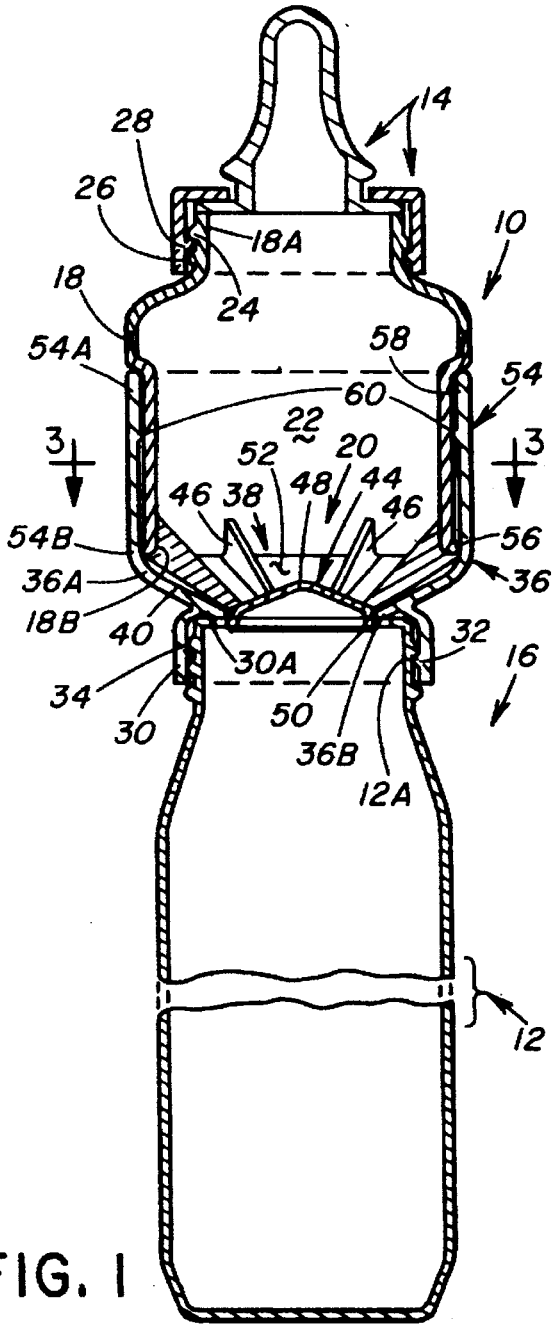
FIG. 1 is a vertical sectional view of a first embodiment of a bottle extension assembly of the present invention coupled between an upper end of a tubular container of a baby bottle of the standard type for feeding a baby and a lower end of the nipple supporting end cap for the tubular container, with the components of the extension assembly being shown in a closed condition.
Figure 4:
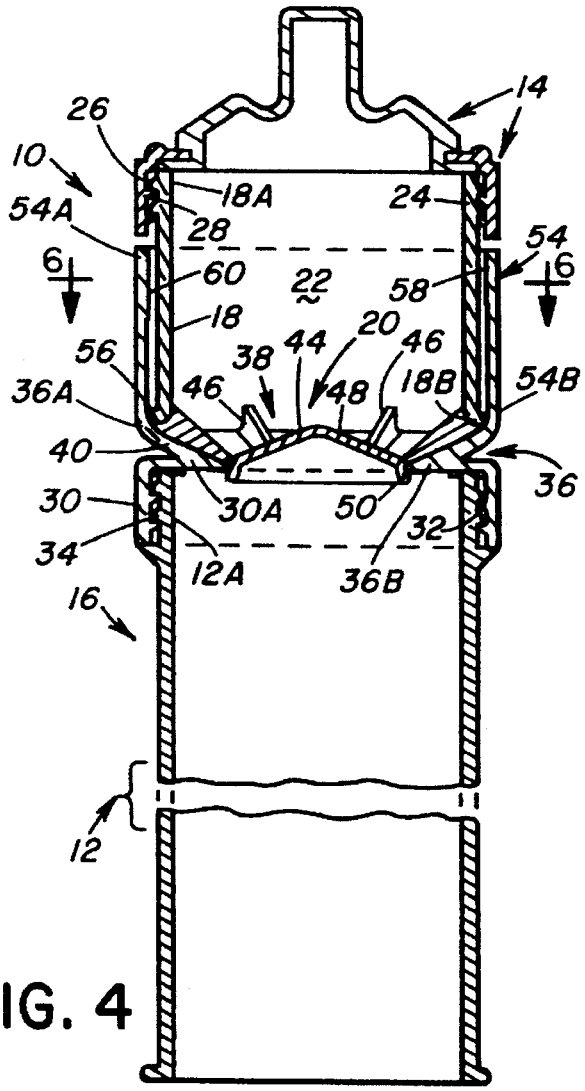
FIG. 4 is a vertical sectional view of a second embodiment of the bottle extension assembly of the present invention coupled between an upper end of a tubular container of a baby bottle for holding a flexible pouch or bag for feeding a baby and a lower end of the nipple supporting end cap for the tubular container, with the components of the assembly being shown in a closed condition.

Referring to the drawings, and particularly to FIGS. 1 and 4, there is illustrated two embodiments of a baby bottle extension assembly of the present invention, generally designated 10. The extension assembly 10 is adapted to fit between a tubular container 12, and a nipple supporting end cap 14 of a baby bottle 16 of either the standard type shown in FIGS. 1 and 2 or the tubular liner type shown in FIGS. 4 and 5 that is adapted to hold a flexible pouch or bag (not shown). The only differences between the two embodiments of the extension assembly 10 is slight differences in the sizes and shapes of some of their components to accommodate the two types of baby bottles 16. However, the same components and relationships therebetween are found in both embodiments of the extension assembly 10. Also, for purposes of brevity, hereinafter both types of baby bottles will be referred to merely as the baby bottle 16.

Referring to FIGS. 1–6, the extension assembly 10 basically includes an elongated container body 18 for storing a quantity of food material and a release mechanism 20 to control access by a liquid, such as water, contained in the tubular container 12 to the food material in the container body 18. The container body 18 is generally cylindrical in shape and has spaced upper and lower open ends 18A, 18B. An internal storage chamber 22 is defined by the container body 18 between the upper and lower ends 18A, 18B thereof for storing the quantity of food material. The container body 18 also has an upper annular attaching structure 24 defined about the upper open end 18A thereof with external threads 26 thereon adapted to threadably connect with internal threads 28 on the end cap 14 of the baby bottle 16. The extension assembly 10 also includes lower annular attaching structure 30 with internal threads 32 thereon adapted to threadably connect with external threads 34 on an upper open end 12A of the tubular container 12 of the baby bottle 16.

The release mechanism 20 of the extension assembly 10 includes a lower annular funnel structure 36 and an upper stopper structure 38. The lower funnel structure 36 of the release mechanism 20 overlies and is rigidly connected to an upper edge 30A of the lower annular attaching structure 30. The lower funnel structure 36 also has an outer annular edge portion 36A, an inner annular edge portion 36B, and an annular wall 40 rigidly connected to the upper edge 30A of and disposed above and overlying the lower annular attaching structure 30. The annular wall 40 of the lower funnel structure 36 slopes from the outer annular edge portion 36A thereof inwardly and downwardly to the inner annular edge portion 36B to a central opening 42 defined by the inner annular edge portion 36B. The central opening 42 is spaced inwardly from the lower annular attaching structure 30 and is aligned with the upper open end 12A of the tubular container 12. The conical sloping shape of the lower funnel structure 36 ensures that the food material in the internal storage chamber 22 of the container body 18 is guided to and downward through the central opening 42 when the release mechanism 20 is operated to release the food material from the container body 18.

Figure 2:
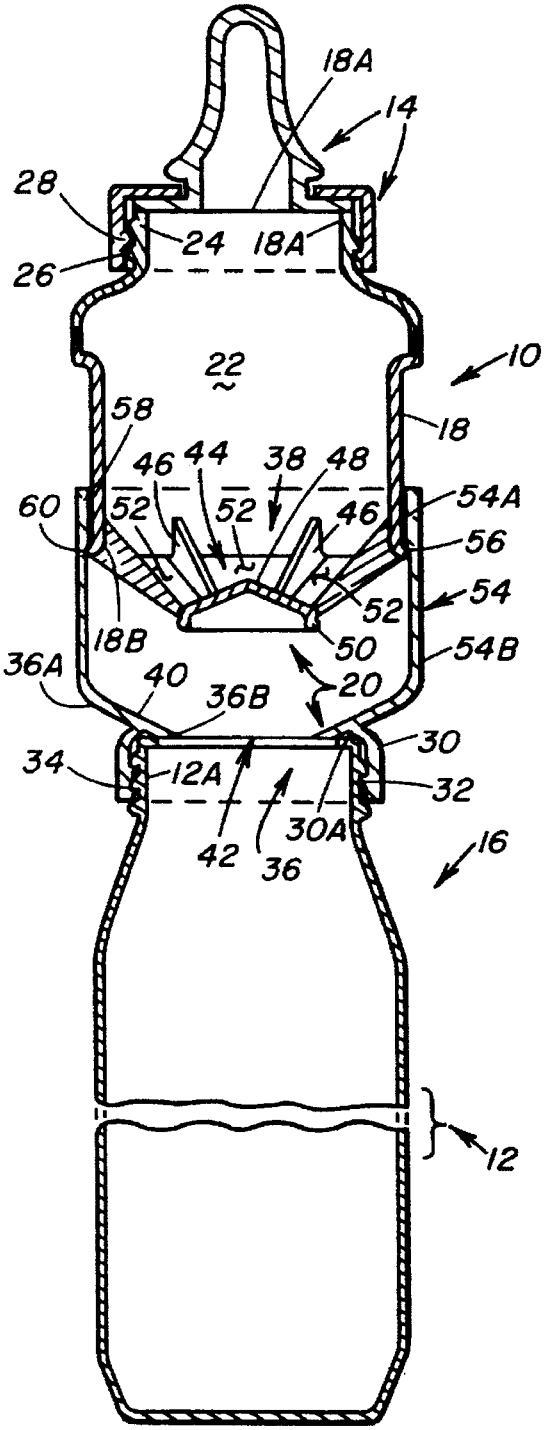
FIG. 2 is a vertical sectional view of the bottle extension assembly of FIG. 1, with the components of the assembly being shown in an opened condition.
Figure 3:
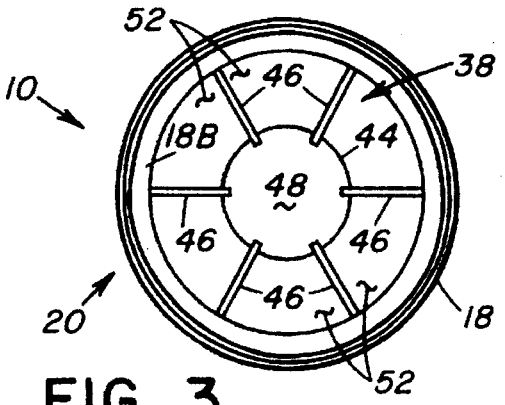
FIG. 3 is a cross-sectional view of a container body of the bottle extension assembly taken along line 3—3 of FIG. 1.
Figure 5:
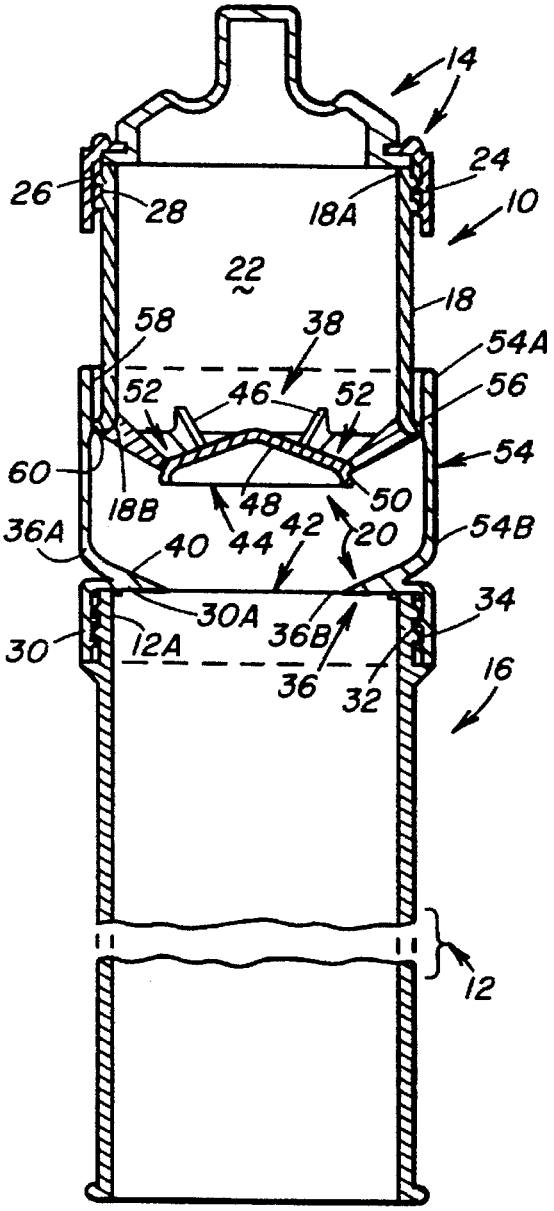
FIG. 5 is a vertical sectional view of the bottle extension assembly of FIG. 4, with the components of the assembly being shown in an opened condition.
Figure 6:
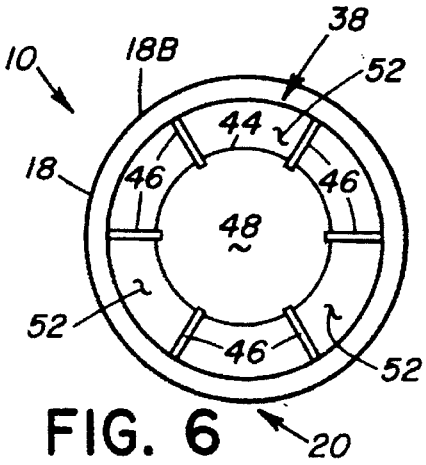
FIG. 6 is a cross-sectional view of a container body of the bottle extension assembly taken along line 6—6 of FIG. 4.

The upper stopper structure 38 of the release mechanism 20 is supported by and spaced from the lower open end 18B of the container body 18 and is movable toward and away from the lower funnel structure 36 between a closed condition, as seen in FIGS. 1 and 4, and an opened condition, as seen in FIGS. 2 and 5, relative to the central opening 42 of the lower funnel structure 36 with vertical movement of the container body 18 toward and away from the upper open end 12A of the tubular container 12. In the closed condition, the upper stopper structure 38 prevents access by water in the tubular container 12 to the food material in the container body 18, whereas in the opened condition such access is permitted.

More particularly, the upper stopper structure 38 includes a central cover 44 and a plurality of radial stokes 46. The central cover 44 has an upwardly convex-shaped top 48 and an annular rim 50 depending from the periphery of the top 48 and having an outside diameter slightly smaller than the diameter of the central opening 42 so that the central cover 44 at its annular rim 50 will sealably seat within the central opening 42 of the lower funnel structure 36 when the upper stopper structure 38 and lower funnel structure 36 are in the closed condition and will unseat therefrom when the upper stopper structure 38 and lower funnel structure 36 are in the opened condition. The radial spokes 46 are circumferentially spaced about the central cover 44 and are attached between the central cover 44 and container body 18. The radial spokes 46 slope at the same angle as the annular wall 40 of the lower funnel structure 36 such that the radial spokes 46 substantially overlie and extend parallel to the annular wall 40. Thus, the radial spokes 46 extend in inwardly and downwardly sloping relation from the lower open end 18B of the container body 18 to the peripheral edge of the top 48 of the central cover 44 so as to axially displace the central cover 44 below the lower open end 18B of the container body 18. Further, the spaced apart radial spokes 46 define passages or spaces 52 between the spokes 46 which permit the shaking and mixing of water from the tubular container 12 with food material from the container body 18 through the spaces 52 and past the radial spokes 46 and central cover 44 and through the central opening 42 of the lower funnel structure 36 when the upper stopper structure 38 is disposed at the opened condition relative to the lower funnel structure 36.

The extension assembly 10 also includes means preferably in the form of a cylindrical outer mounting sleeve 54 attached to and extending upwardly from the outer annular edge portion 36A of the lower funnel structure 36 for receiving the container body 18 in the sleeve 54 and mounting the container body 18 to undergo sliding movement toward and away from the tubular container 12 so as to move and convert the upper stopper structure 38 relative to the lower funnel structure 36 of the release mechanism 20 respectively between the closed condition, blocking access by the water in the tubular container 12 with the food material in the container body 18, and the opened condition, permitting access by the water in the tubular container 12 to the food material stored in the container body 18 to facilitate shaking and mixing of the water with the food material. The outer sleeve 54 has spaced upper and lower ends 54A, 54B. As mentioned above, the outer sleeve 54 at the lower end 54B is fixedly attached to the outer annular edge portion 36A of the lower funnel structure 36 of the release mechanism 20. Also, the lower end 18B of the inner container body 18 has an exterior lower annular lip 56 thereon which projects outwardly from the exterior surface of the container body 18 and is slightly larger in outside diameter than an inside diameter of an interior upper annular flange 58 on the upper end 54A of the outer sleeve 54. Thus, the upper annular flange 58 of the outer sleeve 54 will limit upward movement of the lower annular lip 56 and thereby of the container body 18 upwardly away from the upper end 12A of the tubular container 12. The upper annular flange 58 thus defines a stop structure on the upper end 54A of the outer sleeve 54 projecting radially inwardly therefrom. Preferably, an annular depression or recess 60 is formed in the interior surface of the outer sleeve 54 just below the interior upper annular flange 58 which receives the lower exterior annular lip 56 on the container body 18 so as to retain the container body 18 in the upwardly displaced opened condition, as shown in FIGS. 2 and 5.

Further, the container body 18 has an outside diameter sufficiently less than an outside diameter of the outer sleeve 54 such that the container body can extend from the upper end 54A of the outer sleeve 54 past the inwardly projecting annular flange 58 thereon when in the upwardly displaced opened condition. The container body 18 is fitted within the outer sleeve 54 for undergoing axial sliding movement between the upper and lower ends 54A, 54B thereof.

In summary, the baby bottle extension assembly 10 is adapted to fit between the tubular container 12 and the nipple supporting end cap 14 of the baby bottle 16. Annular seals are preferably formed between the respective engaged portions of the lower and upper ends of the extension assembly 10 and the tubular container 12 and end cap 14. The extension assembly 10 includes a plurality of components, as described above, which couple with the upper end 12A of the tubular container 12 to the nipple end cap 14. The components of the extension assembly 10 which define the food material internal storage chamber 22 and the access control or release mechanism 20 of the assembly 10 are made of any suitable material, such as an injection moldable plastic, and are adjustable, either by push-pull or rotating, between closed, or storage, and opened, or release, conditions.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An extension assembly adapted to fit between a tubular container and a nipple end cap of a baby bottle, said extension assembly comprising:

(a) an elongated container body for storing food material, said container body having spaced upper and lower open ends, an internal storage chamber defined between said upper and lower ends, and an upper attaching structure defined about said upper open end and adapted to connect with a nipple end cap of a baby bottle;

(b) a lower annular attaching structure adapted to connect with an upper open end of a tubular container of the baby bottle;

(c) a release mechanism to control access by water in the tubular container to the food material in said container body, said release mechanism including (i) a lower annular funnel structure overlying and connected to said lower annular attaching structure, said annular funnel structure having an outer annular edge portion, an inner annular edge portion, and an annular wall disposed above and overlying said lower annular attaching structure and sloping from said outer annular edge portion inwardly and downwardly to said inner annular edge portion and a central opening defined by said inner annular edge portion, said central opening being spaced inwardly from said lower annular attaching structure and aligned with the upper open end of the tubular container, and (ii) a central stopper structure supported by and spaced from a lower end of said storage container and movable toward and away from said lower annular funnel structure between closed and opened conditions relative to said central opening of said lower annular funnel structure with movement of said container body toward and away from the upper end of the tubular container to thereby respectively prevent and permit access by water in the tubular container to the food material in said container body; and (d) means attached to and extending upwardly from said outer annular edge portion of said annular funnel structure for mounting said container body to undergo movement toward and away from the tubular container so as to convert said release mechanism between said closed condition blocking access by the water in the tubular container with the food material in said container body and said opened condition permitting access by the water in the tubular container to the food material stored in said container body to facilitate shaking and mixing of the water with the food material.

2. The assembly of claim 1 wherein said upper stopper structure includes a central cover having a top and an annular rim depending from a periphery of said top and sealably seated within said central opening of said lower annular funnel structure when said upper stopper structure and said lower funnel structure are in said closed condition and being unseated therefrom when said upper stopper structure and lower funnel structure are in said opened condition.

3. The assembly of claim 2 wherein said upper stopper structure also includes a plurality of radial spokes extending between and attached to a peripheral edge of said top of said central cover and said lower annular open end of said container body, said radial spokes being spaced apart so as to define spaces therebetween which permit the shaking and mixing of water with food material through said spaces pass said radial spokes and central cover and through said central opening of said lower funnel structure when said upper stopper structure is at an opened condition relative to said lower funnel structure.

4. The assembly of claim 1 wherein said mounting means is an annular outer sleeve having spaced upper and lower ends, said outer sleeve at said lower end being attached to said outer annular edge portion of said lower funnel structure of said release mechanism.

5. The assembly of claim 4 wherein said outer sleeve at said upper end has a stop structure defined thereon for limiting movement of said container body away from the upper end of the tubular container.

6. The assembly of claim 5 wherein said stop structure defined on said upper end of said outer sleeve is an annular flange projecting radially inwardly therefrom.

7. The assembly of claim 5 wherein said container body has an exterior lower annular lip formed about said lower open end thereof projecting outwardly from an exterior surface of said container body and slightly larger in outside diameter than an inside diameter of said stop structure defined on said upper end of said outer sleeve such that said stop structure will limit upward movement of said lower annular lip and thereby of said container body away from the tubular container.

8. The assembly of claim 7 wherein said outer sleeve has an annular recess formed in an interior surface thereof just below said stop structure which will receive said exterior lower exterior annular lip on said container body so as to retain said container body at said opened condition.

9. The assembly of claim 6 wherein said container body has an outside diameter sufficiently less than an outside diameter of said outer sleeve such that said container body extends from said upper end of said outer sleeve past said inwardly projecting annular flange thereof.

10. The assembly of claim 4 wherein said container body is fitted within said outer sleeve for axial sliding movement between said upper and lower ends thereof.

11. The assembly of claim 1 wherein said upper attaching structure on said container body is a set of external threads for connecting with an internally threaded lower end of the nipple end cap of the baby bottle.

12. The assembly of claim 1 wherein said lower attaching structure has a set of threads formed on an interior surface thereof for screwing said lower attaching structure onto an externally threaded upper end of the tubular container.

13. A baby bottle, comprising:

(a) a tubular container having a threaded upper end;

(b) a nipple end cap having a threaded lower end; and (c) an extension assembly adapted to fit between said tubular container and said nipple end cap, said extension assembly comprising (i) an elongated container body for storing food material, said container body having spaced upper and lower open ends, an internal storage chamber defined between said upper and lower ends, and upper threads defined about said upper open end and adapted to threadably connect with said threaded lower end of said nipple end cap, (ii) a lower annular attaching structure having lower threads adapted to threadably connect with said threaded upper open end of said tubular container, (iii) a release mechanism to control access by water in said tubular container to the food material in said container body, said release mechanism including a lower annular funnel structure overlying and connected to said lower annular attaching structure, said annular funnel structure having an outer annular edge portion, an inner annular edge portion, and an annular wall disposed above and overlying said lower annular attaching structure and sloping from said outer annular edge portion inwardly and downwardly to said inner annular edge portion and a central opening defined by said inner annular edge portion, said central opening being spaced inwardly from said lower annular attaching structure and aligned with said upper open end of said tubular container, said release mechanism also including a central stopper structure supported by and spaced from said lower end of said container body and movable toward and away from said lower annular funnel structure between closed and opened conditions relative to said central opening of said lower annular funnel structure with movement of said container body toward and away from said upper end of said tubular container to thereby respectively prevent and permit access by water in said tubular container to the food material in said container body, and (iv) means attached to and extending upwardly from said outer annular edge portion of said annular funnel structure for mounting said container body to undergo movement toward and away from said tubular container so as to convert said release mechanism between said closed condition blocking access by the water in said tubular container with the food material in said container body and said opened condition permitting access by the water in said tubular container to the food material stored in said container body to facilitate shaking and mixing of the water with the food material.

14. The bottle of claim 13 wherein said upper stopper structure includes a central cover having a top and an annular rim depending from a periphery of said top and sealably seated within said central opening of said lower annular funnel structure when said upper stopper structure and said lower funnel structure are in said closed condition and being unseated therefrom when said upper stopper structure and lower funnel structure are in said opened condition.

15. The bottle of claim 14 wherein said upper stopper structure also includes a plurality of radial spokes extending between and attached to a peripheral edge of said top of said central cover and said lower annular open end of said container body, said radial spokes being spaced apart so as to define spaces therebetween which permit the shaking and mixing of water with food material through said spaces pass said radial spokes and central cover and through said central opening of said lower funnel structure when said upper stopper structure is at an opened condition relative to said lower funnel structure.

16. The bottle of claim 13 wherein said mounting means is an annular outer sleeve having spaced upper and lower ends, said outer sleeve at said lower end being attached to said outer annular edge portion of said lower funnel structure of said release mechanism.

17. The bottle of claim 16 wherein said outer sleeve at said upper end has a stop structure defined thereon for limiting movement of said container body away from said upper end of said tubular container.

18. The bottle of claim 17 wherein said container body has an exterior lower annular lip formed about said lower open end thereof projecting outwardly from an exterior surface of said container body and slightly larger in outside diameter than an inside diameter of said stop structure defined on said upper end of said outer sleeve such that said stop structure will limit upward movement of said lower annular lip and thereby of said container body away from the tubular container.

19. The bottle of claim 18 wherein said outer sleeve has an annular recess formed in an interior surface thereof just below said stop structure which will receive said exterior lower exterior annular lip on said container body so as to retain said container body at said opened condition.

20. The bottle of claim 16 wherein said container body is fitted within said outer sleeve for axial sliding movement between said upper and lower ends thereof.

* * * * *